United States Patent [19]

Rowley et al.

[11] B 3,995,738

[45] Dec. 7, 1976

[54] SHIPPING BIN FOR SHEETS WITH DEVICE FOR RESTRAINING MOVEMENT OF THE SHEETS

[75] Inventors: James R. Rowley, Freeport; Walter E. Pater, Lower Burrell, both of Pa.

[73] Assignee: PPG Industries, Inc., Pittsburgh, Pa.

[22] Filed: June 20, 1973

[21] Appl. No.: 371,912

[44] Published under the second Trial Voluntary Protest Program on March 2, 1976 as document No. B 371,912.

[52] U.S. Cl. ..... 206/451; 206/448; 206/452

[51] Int. Cl.[2] ..... B65D 85/48

[58] Field of Search ..... 206/451, 454, 448, 523, 206/452

[56] References Cited

UNITED STATES PATENTS

| | | | |
|---|---|---|---|
| 2,156,876 | 5/1939 | Scull | 206/454 X |
| 2,885,221 | 5/1959 | Weeks | 280/179 |
| 3,061,085 | 10/1962 | Hoskins et al. | 206/451 |
| 3,346,221 | 10/1967 | Farmer | 206/523 X |
| 3,596,755 | 8/1971 | Bundy et al. | 206/451 |
| 3,809,234 | 5/1974 | Kurick | 206/448 |

FOREIGN PATENTS OR APPLICATIONS

| | | | |
|---|---|---|---|
| 68,857 | 9/1969 | Germany | 206/454 |

*Primary Examiner*—Leonard Summer
*Attorney, Agent, or Firm*—Donald Carl Lepiane

[57] ABSTRACT

A method of and device for restraining rotational motion of articles, for example, glass sheets, automotive backlites or automotive windshields, during transit are disclosed. The articles are positioned on an edge and tilted to rest on back support members. A first force is applied to a top portion of the articles and a second force is applied to a bottom portion of the articles to urge the articles against the back support members. During transit, the articles tend to rotate about the edge but are restrained by the first force which is approximately equal to or greater than the resultant moment of force acting on the top portion of the articles and the second force which is approximately equal to or greater than the resultant moment of force acting on the bottom portion of the articles.

17 Claims, 6 Drawing Figures

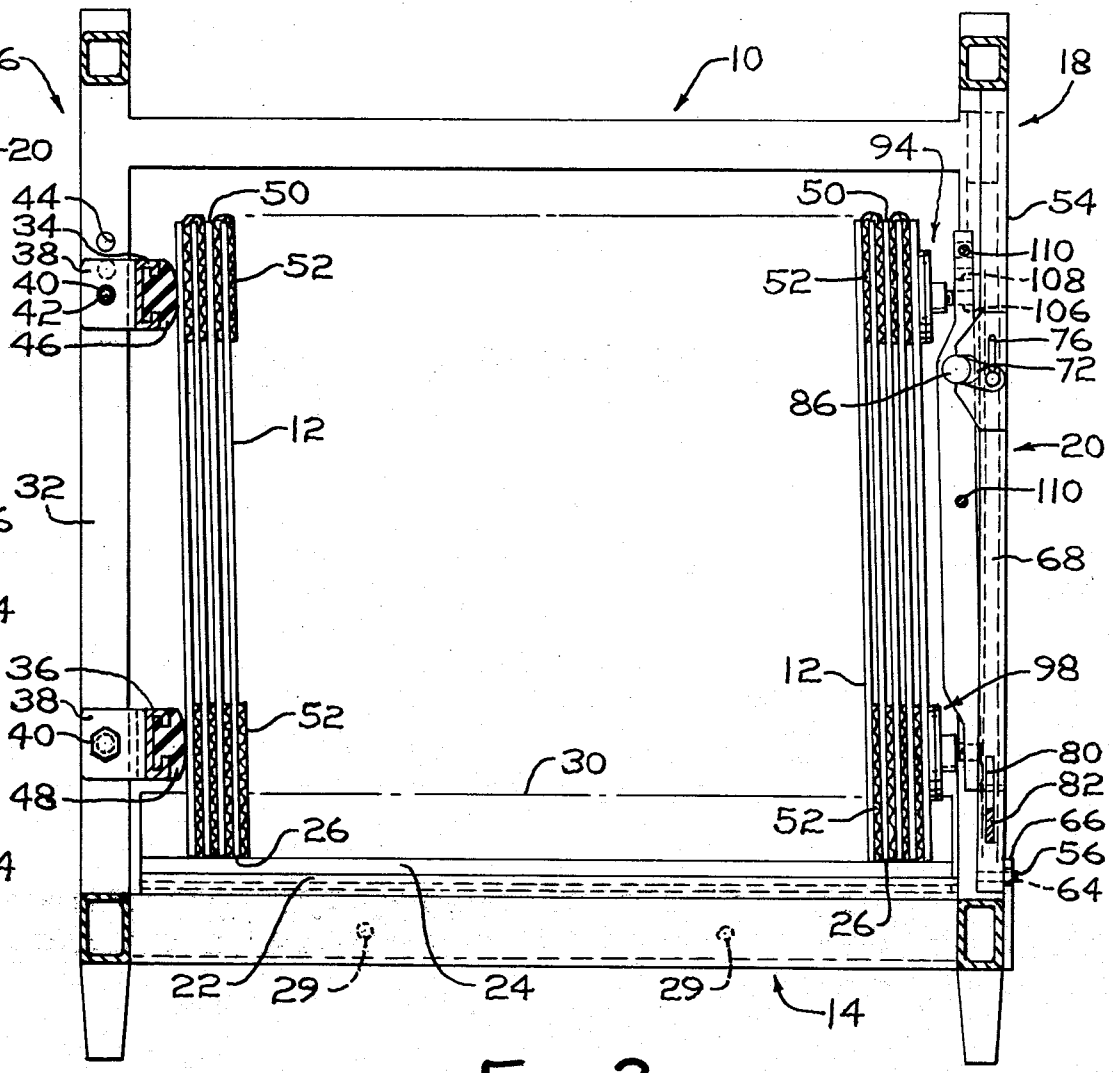
FIG. 3
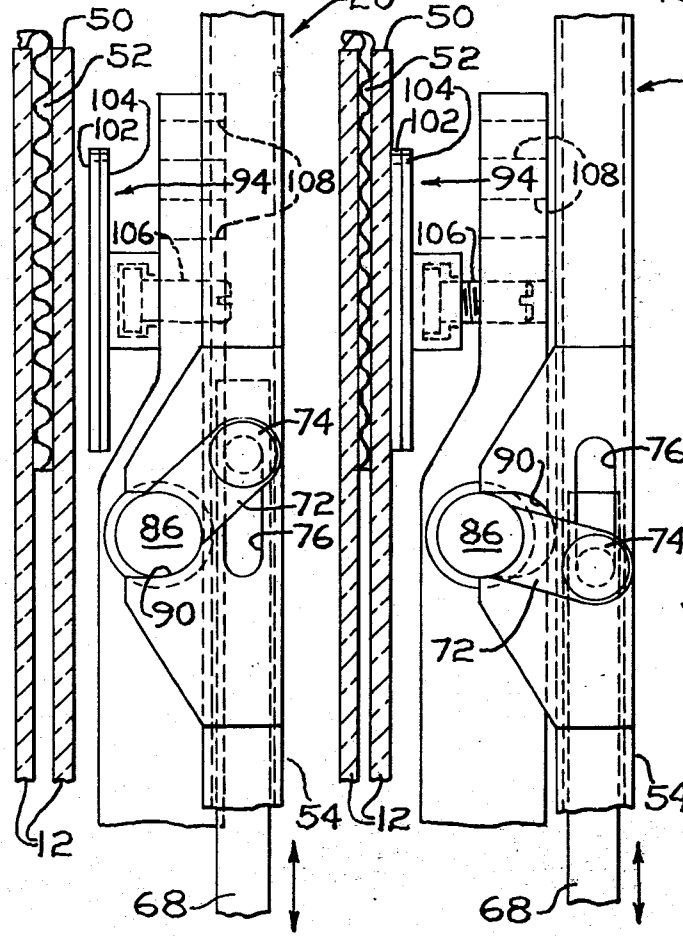
FIG. 5
FIG. 4

SHIPPING BIN FOR SHEETS WITH DEVICE FOR RESTRAINING MOVEMENT OF THE SHEETS

BACKGROUND OF THE INVENTION

1. Field of the Invention

This invention relates to a method of and device for restraining the rotational motion of articles, for example, glass sheets, automotive backlites or automotive windshields, during transit by applying forces of different magnitude to selected portions of the articles.

2. Discussion of the Prior Art

Glass articles, e.g. glass sheets, automotive backlites or automotive windshields, are normally shipped to automotive manufacturers in bins or racks. To prevent damage to the glass articles during shipping, several expediencies are employed.

The windshields are normally loaded in racks in a generally vertical position with an edge of the windshields resting on a resilient pad and the windshields tilted toward and resting on back support members. Corrugated cardboard spacers are inserted between each windshield to prevent surface contact between adjacent windshields which could mar the windshield surface. A restraining system such as polyester webbing or steel bands is used to urge the windshields toward the back support members. The racks are loaded either on freight cars or trucks for shipment to automotive manufacturers.

During transit, the swaying motion of the freight car imparts a moment of force to the windshields which rotates the windshields about the edge resting on the pad. The windshields oscillate about the edge which causes the webbing to stretch, thereby increasing the path of oscillation. As the path of oscillation increases, the force of the windshields hitting the back support members increases which causes the windshields to break.

U.S. Pat. No. 2,953,253 discloses a windshield container having a restraining system that eliminates the drawbacks associated with polyester webbing or steel bands, but has limited use. In general, the container is provided with a plurality of spaced, stationary, upright members and a plurality of spaced, movable, upright members. Each of the stationary upright members is spaced from one of the movable upright members to form slots for receiving individual windshields. The movable upright members, e.g. a pair of spaced pressure pads, are urged toward their adjacent stationary members about the windshields to prevent motion of the windshields during transit.

The restraining system of the above-mentioned patent is acceptable for restraining individual windshields but not for restraining a plurality of windshields because the force applied by the pair of spaced pressure pads is uniform. As can be appreciated, the moment of force required to rotate a generally flat object about an axis decreases as the distance from the axis of rotation increases. Applying uniform forces to different portions, i.e., a top and bottom section of the windshields, to prevent rotation thereof puts a bending moment on the windshields which can cause them to crack. More particularly, if the forces applied to the windshields are equal and of sufficient magnitude to overcome the resultant moment of force acting on the section of the windshield closest to the axis of rotation, insufficient force will be applied to the section of the windshield farthermost from the axis of rotation. If the forces applied are equal and of sufficient magnitude to overcome the resultant moment of force acting on the portion farthermost from the axis of rotation, excessive force will be applied to the section of the windshield closest to the axis of rotation. "Resultant moment of force", as the term is used herein, is the difference between the moment of force acting at points on the articles which tend to rotate the articles in one direction less the force generated by the articles to resist the rotation, e.g. the angle of tilt and the weight of the articles.

In each instance a bending moment is imparted to the windshields that could cause the windshields to crack. As the number of articles increases, the applied force needed to prevent rotation increases, thereby increasing the bending moment. For this reason, a restraining system that applies equal forces at various distances from the axis of rotation such as the one disclosed in the above-mentioned application is not acceptable for restraining the rotational movement of a plurality of windshields.

U.S. Pat. No. 2,156,876, assigned to PPG Industries, Inc., discloses a safety rack in which glass plates are loaded in a vertical position on one edge and rest on a back support. The glass plates are separated by wire spacers. The plates are urged against the back support by an upright arm carrying a block adapted to engage the face of the outermost plate on the rack. The arm is pivotally mounted on a shoe which freely rides on a bar toward and away from the glass sheets. The arm and block are maintained in position by the corner of the arm engaging the bar.

This type of container has limitations for shipping glass plates because the vibration encountered during transit tends to disengage the corner of the arm from the bar moving the block away from the glass sheets. When this occurs, the path of oscillation of the glass increases which can cause the glass to be damaged.

SUMMARY OF THE INVENTION

This invention relates to a method of preventing rotational motion of articles, wherein the articles are resting on a first edge and moments of force are applied to the articles to cause a second edge spaced from the first edge to oscillate, including the steps of applying a first force to a first section of the articles adjacent the second edge wherein the first force is approximately equal to or greater than the resultant moment of force at the first section of the articles, and applying a second force to a second section of the articles adjacent the first edge, wherein the second force is less than the first force.

This invention also relates to a restraining device for preventing rotational movement of articles, wherein the articles are resting on a first edge and moments of force are applied to the articles to cause a second edge spaced from the first edge to rotate through an arcuate path, including facilities for applying a force to a first section of the article adjacent the second edge, wherein the first force is approximately equal to or greater than the resultant moment of force applied to the first section of the article, and facilities for applying a second section force to a second section of the article adjacent the first edge, wherein the second force is less than the first force.

In the conventional manner of loading automotive windshields in a rack, the windshields are positioned in an upright position with a first edge resting on resilient pads and the windshields tilting toward and resting on back support members. During shipment a moment of force is applied to the windshields which tends to rotate the windshields about the first edge. As can be appreciated, the moment of force required to rotate an article about an axis of rotation decreases as the distance from the axis of rotation increases. Applying a first force adjacent the edge farthermost from the first edge of the windshield which is equal to or greater than the resultant moment of force acting on the top of the windshields and applying a second force adjacent the first edge of the windshield which is equal to or greater than the resultant moment of force acting on the bottom of the windshields, the windshields are generally held stationary without imparting a bending moment to the windshields.

BRIEF DESCRIPTION OF THE DRAWING

FIG. 3 is a view taken along lines 3—3 of FIG. 2 having portions cut away for purposes of clarity;

FIG. 4 is a fragmented top side view of the restraining device of the invention in a non-engaging position;

FIG. 5 is similar to the view in FIG. 4 with the restraining device in an engaging position.

DESCRIPTION OF THE INVENTION

Figure 1:
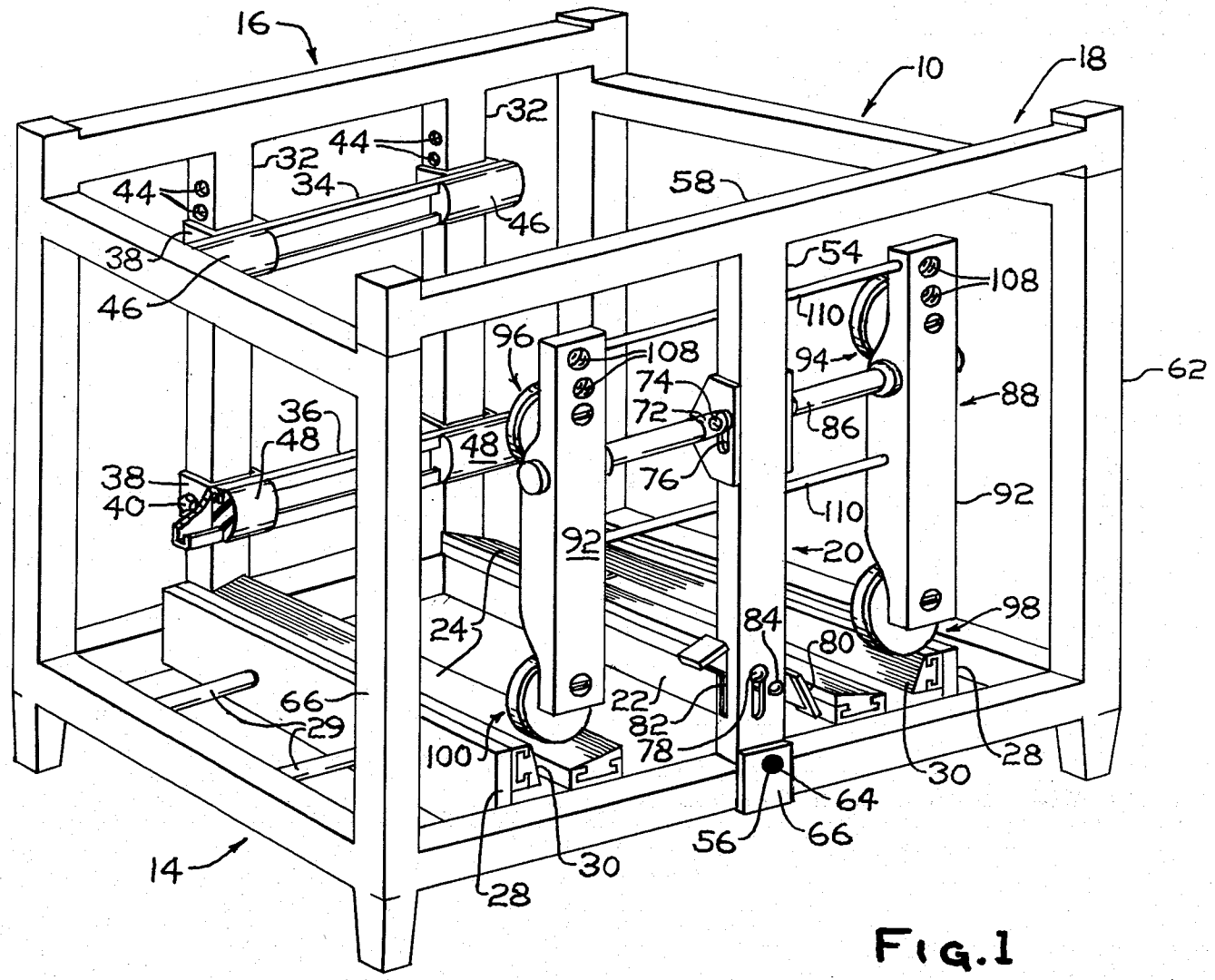
FIG. 1 is an isometric view having portions cut away for purposes of clarity of a rack used for loading automotive windshields employing the restraining device of the invention.

Referring to FIG. 1, there is shown a conventional rack 10 used for transporting articles 12 (see FIGS. 2 and 3), for example, glass plates, automotive windshields or automotive sidelites, including a base 14 and a back wall 16, as viewed in FIG. 1. Mounted at ingress end 18 or front end of the rack 10, as viewed in FIG. 1, is a restraining device 20 embodying the principles of the invention.

The base 14 includes a pair of stationary runners 22 each having resilient pads 24 for supporting the articles 12 on an edge 26 and movable runners 28 mounted on guiderails 29 and having a resilient pad 30. The runners 28 are locked in position against sides of the articles to prevent longitudinal movement of the articles during transit (shown better in FIG. 2).

With reference to FIGS. 1 and 3, the back wall 16 includes a pair of stationary vertical cross members 32 on which are fastened top and bottom back support members 34 and 36 in any conventional manner as by way of "U"-shaped clamps 38 and bolts 40 which pass through holes 42 in the clamp and holes 44 in the cross members 32.

Each of the back support members 34 and 36 are provided with a pair of resilient pads 46 and 48, respectively. As shown in FIG. 3, the back support member 36 extends away from the cross members 32 a greater distance than the support member 34. This is to provide a tilt to the articles of about 5° for packing stability.

As can be seen in FIG. 3, the top portions of the cross members 32 are provided with a plurality of holes 44 for positioning the support member 34 at different spaced distances from top edge 50 of the articles as viewed in FIG. 3. This is so that the pressure brought to the articles 12, e.g. windshields, as a result of the tilt is not at the top edge 50 of the articles. This reduces to a minimum the possibility of damage. Since the articles are resting on the bottom edge 26, the bottom support member 36 is normally maintained at a set position relative to the base 14 of the rack 10.

The articles 12 are positioned in the rack 10 in a vertical position with the edges 26 of the articles resting on the resilient pads 24 of the stationary runners 22 and tilted toward the back wall resting on resilient pads 46 and 48 of the back support members 34 and 36, respectively. Corrugated cardboard spacers 52 separate the articles from one another to prevent surface damage of the articles and normally extend from the edge 26 and 50 of the articles beyond the adjacent resilient pads 46 and 48, respectively, as shown in FIG. 3.

Figure 2:
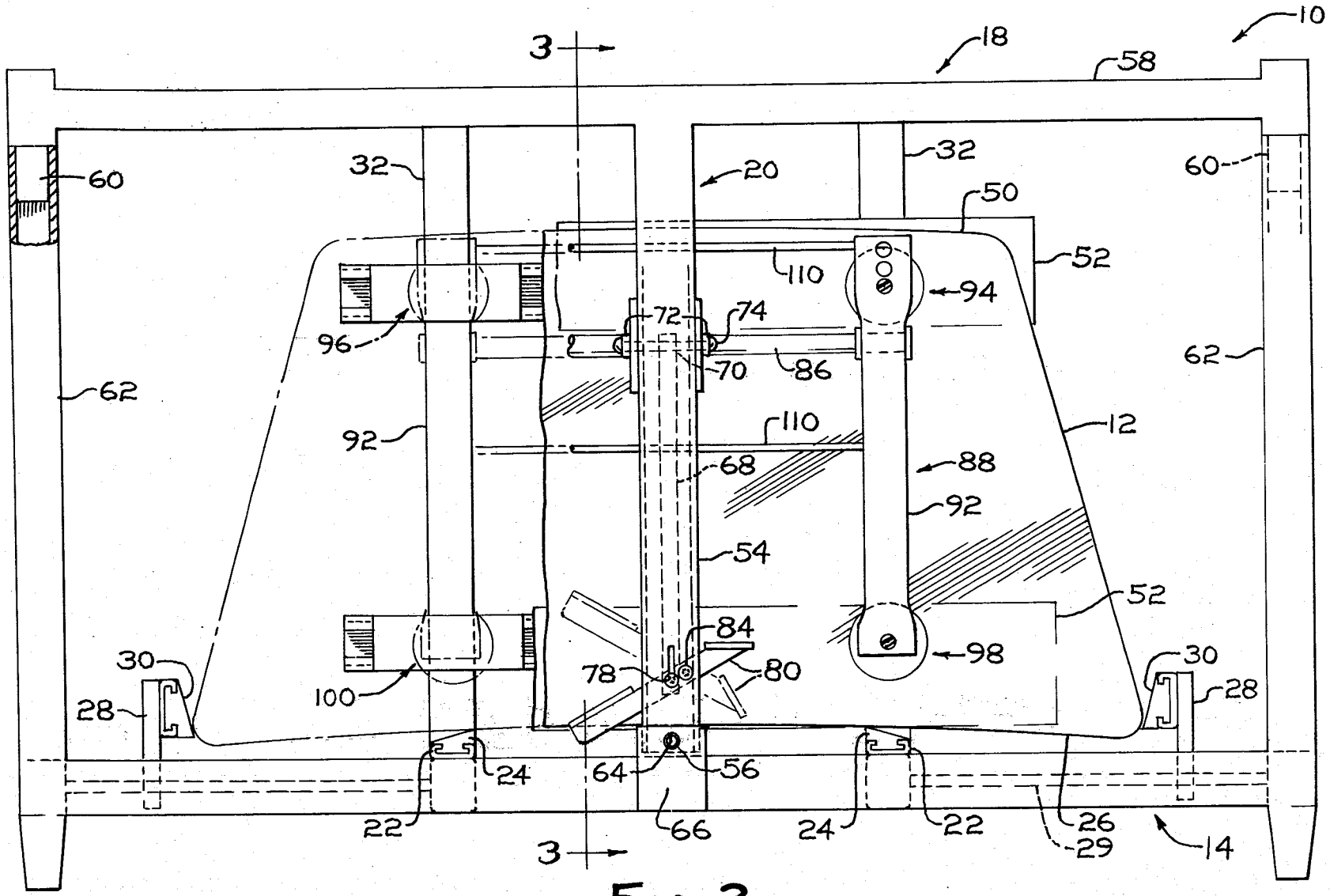
FIG. 2 is an elevated front view of the rack of FIG. 1 having portions cut away for purposes of clarity loaded with windshields.

Referring now to FIGS. 1 and 2, the discussion will be directed to the restraining device 20 which embodies the principles of the invention. Restraining device 20 includes a hollow rigid member 54 having a stud 56 mounted at the bottom thereof and the top of the rigid member is securely mounted to a span member 58 as viewed in FIGS. 1 and 2, having male inserts 60 at its ends (see FIG. 2). The restraining device is mounted at the ingress end 18 of the rack by inserting the male inserts 60 of the span member 58 into ends of posts 62, as shown in FIG. 2, and sliding the stud 56 in hole 64 of a retaining plate 66 mounted to the base 14 (see also FIG. 3). In this manner, the restraining device 20 is held in position during shipment of the articles and may be easily removed to load or unload the articles from the rack 10.

Referring now to FIG. 2, a rigid bar 68 is mounted in the rigid member 54 and pivotally connected at 70 to one side of a pair of plates 72 by a stud 74 (see also FIGS. 4 and 5). The stud 74 rides in slots 76 formed in opposite sides of the hollow member 54 (shown better in FIGS. 4 and 5). The other end of the bar 68 is pivotally connected at 78 to a lever 80. The lever 80 passes through the hollow member 54 at 82 (see FIG. 3) and is pivotally connected at 84 to the hollow member 54 as shown in FIG. 2. Rotating the lever 80 clockwise displaces the bar 68 upwards and rotating the lever 80 counterclockwise displaces the bar 68 downward as viewed in FIG. 2.

With reference to FIGS. 1, 4 and 5, the other end of each plate 72 is connected to a middle leg 86 of a generally H-shaped member 88. When the bar 68 is displaced upward, the stud 74 is displaced upward in the slot 76 to displace the H-shaped member away from the articles 12 while moving the middle leg 86 in a nest 90 mounted on the member 54. When the bar 68 is displaced downward, the stud 74 is displaced downward in the slot 76 to move the middle leg 86 out of the nest urging the H-shaped member toward the back wall 16 to compress the spacers 52 between the articles. To prevent the H-shaped member from disengaging the articles during transit due to vibrations, the bottom portion of the slot 76 extends below the nest 90 to displace the stud 74 slightly below the nest as shown in FIG. 5.

As can be appreciated, the direction of rotation of the lever 80 to urge the H-shaped member 88 against the articles is optional. However, it has been found that displacing the bar 68 downward urges the stud 74 against the bottom portion of the slot 76 as viewed in FIG. 5, thereby preventing movement thereof as a result of vibrations. If the H-shaped member 88 is urged against the articles when the stud engages the top of the slot as viewed in FIG. 5, vibrations encountered during transit tends to drop the stub in the slot thereby displacing the H-shaped member away from the articles.

With reference to FIG. 1, outer legs 92 of the H-shaped member 88 are pivotally mounted at the ends of the middle leg 86 in any conventional manner. Each of the outer legs 92 are provided at one end with top pressure pads 94 and 96 and at the opposite end with bottom pressure pads 98 and 100. Referring to FIGS. 4 and 5, each of the pressure pads includes a layer 102 of resilient material bonded to a rigid plate 104 in any conventional manner. The rigid plate is pivotally mounted to an end of a threaded shaft 106 as shown in FIGS. 4 and 5 to move the pads into engagement with the outermost articles prior to rotating the lever 80 to compress the spacers 52.

The area of the pressure pads 94, 96, 98, 100 is selected so that the force applied by the pressure pads to the articles is distributed over a relatively large area to prevent concentration of force which could damage the articles. In general, pressure pads having a diameter of about between 4 to 6 inches are recommended.

It is recommended that the distance between the left side of the articles from the pressure pads 96 and 100 and between the right side of the articles from pressure pads 94 and 98, as shown in FIG. 2, does not exceed about one half the distance between pads 94, 98 and 96, 100, respectively. This arrangement prevents the sides of the windshields (see FIG. 2) from bending about the pressure pads during transit.

Referring specifically to FIG. 3, the bottom pressure pads 98 and 100 are in spaced alignment with each of the bottom resilient pads 48 and the top pressure pads 94 and 96 are in spaced alignment with each of the top resilient pads 46. Although it is recommended that the pressure pads be in spaced alignment with the resilient pads so that the force applied by the pressure pads will be in line with the resilient pads, thereby eliminating any bending moment to the windshield, it can be appreciated by those skilled in the art that the invention is not limited thereto. To maintain the alignment of the top pressure pads 94 and 96 with the resilient pads 46, the outer legs 92 are provided with a plurality of threaded holes 108 in spaced alignment with the threaded holes 44 at the top of the cross members 32.

In general, the throw of the H-shaped member, i.e., the movement of the middle leg 86 out of the nest 90 (see FIG. 5) to compress the spacers 52 between the articles is determined by (1) the number, (2) thickness, and (3) resiliency of the corrugated cardboard spacers 52, (4) the resiliency of the layer 102 of resilient material of the pressure pads, and (5) the resiliency of the pads 46 and 48 of the members 34 and 36, respectively. The throw should be sufficient to urge the articles toward each other against the resilient pads 46 and 48 of the support members 34 and 36, respectively, without applying excessive pressure that could crack the articles. As can be appreciated, as the H-shaped member urges the articles toward the resilient pads 46 and 48, the corrugated spacers 52 are compressed. If excessive pressure is applied, the spacers are beyond being compressed and excessive forces are applied to the articles which could crack them.

The articles are urged against the restraint pads 46 and 48 to compress the corrugated spacers so that during transit the articles tend to oscillate about the bottom edge 26 generally as a unit. In general, (1) as the number of spacers 52 increases, the remaining parameters kept constant, the throw of the H-shaped member 88 increases; (2) as the thickness of the spacers 52 increases, the remaining parameters kept constant, the throw of the H-shaped member 88 increases; (3) as the resiliency of the spacers 52 increases, the remaining parameters kept constant, the throw of the H-shaped member 88 increases; (4) as the resiliency of the resilient material 102 of the pressure pads 94 increases, the remaining parameters kept constant, the throw of the H-shaped member 88 increases; and (5) as the resiliency of the resilient pads 46 and 48 increases, the remaining parameters kept constant, the throw of the H-shaped member 88 increases.

Referring specifically to FIG. 2, it will be noted that the middle leg 86 of the H-shaped member 88 is closer to the top pressure pads 94 and 96 than the bottom pressure pads 98 and 100. This is so the force applied to the top portion of the articles by the top pressure pads is greater than the force applied to the bottom portion of the articles by the bottom pressure pads as viewed in FIG. 2. By employing this arrangement, the rotational motion of the articles about the bottom edge 26 is generally prevented without applying a bending moment between the edges 26 and 50 of the articles during transit.

In this regard, consider the following. The bottom edge 26 of the articles are generally held stationary by the resilient pads 24 and forces acting on the articles during transit generally rotate the edge 50 of the articles through an arcuate path about the edges 26, i.e., the axis of rotation. The forces acting on the articles to rotate the articles about the axis of rotation can be considered to be uniform from the edge 50 to the edge 26. The resultant moment of force increases as the distance from the edge 26 toward the edge 50 increases. Therefore, the resultant moment of force at the edge 50 of the articles is greater than at the edge 26 of the articles. "The resultant moment of force," as the term is used herein, is defined as the difference between the moment of force acting at points on the article which tend to rotate the article in one direction, i.e., away from the back wall 16 less the force generated by the articles to resist the rotation, i.e., the force generated by the tilt and weight of the articles. If equal forces were applied by the pressure pads 94, 96, 98 and 100 to the articles to prevent rotation thereof, a bending moment will be applied to the articles between the edges 26 and 50.

More particularly, if the forces applied by the pressure pads 94, 96 and 98, 100 are (1) equal to each other and (2) equal to or greater than the resultant moment of force acting on the top portion of the articles 12 as viewed in FIG. 2, a bending moment would be applied to the articles between the edge 26 and the bottom pressure pads 98 and 100. This is because the force of the bottom pressure pads 98 and 100 exceeds the resultant moment of force acting at the bottom portion of the articles, as viewed in FIG. 2, and urges the bottom portion toward the back wall of the rack. The edge 26 is frictionally engaged by the resilient pads 24 and resists the movement toward the back wall of the rack which sets up bending moments in the articles between the bottom pressure pads 98 and 100 and the edge 26 of the articles.

If the forces applied by the pressure pads 94, 96 and 98, 100 are (1) equal to each other and (2) equal to the resultant moment of force acting on the bottom portion of the articles as viewed in FIG. 2, a bending moment would be applied to the articles between the bottom pressure pads 98 and 100 and the edge 50 of the articles. In this instance, the force of the bottom pressure pads 98 and 100 prevent the bottom portion of the articles as viewed in FIG. 2 from moving away from the back wall of the rack, but the resultant moment of force at the top portion of the articles as viewed in FIG. 2 exceeds the force of the top pressure pads 94 and 96 and is free to move away from the back wall of the rack.

Another advantage of positioning the middle leg 86 closer to the pressure pads 94 and 96 is that the middle leg can have reduced strength. This is because the total force, i.e., the sum of the forces acting against the top and bottom pressure pads, decreases as the distance between the middle leg and top pressure pads decreases. More particularly, the largest resultant moment of force acts at the edge 50 and the force applied by pressure pads 94 and 96 should be equal to or greater than the resultant moment of force acting near the edge 50. Keeping the pressure applied by the pressure pads 94 and 96 constant and increasing the distance between the middle leg and pressure pads 94 and 96, the force applied to the middle leg increases.

In general, the distance between the middle leg and the top pressure pads 94 and 96 decreases as the width, i.e., the distance between the edges 26 and 50 of the articles, increases. This is because as the width of the articles increases, the resultant moment of force at the top of the articles increases. For articles having a width of 26 inches, the distance between the top pressure pads 94 and 96 and the middle leg should be approximately one-fifth the distance between the middle leg and the bottom pressure pads 98 and 100. For articles having a width of less than about 13 inches, the distance between the pressure pads 94 and 96 and the middle leg would be approximately equal to the distance between the middle leg and the pressure pads 98 and 100.

In addition to preventing a bending moment to the articles between the edges 26 and 50, the path of oscillation of the articles does not increase because there is no permanent displacement of the pressure pads 94, 96, 98 and 100 from the back wall 16 of the rack 10. More particularly, if the resultant moment of force acting on the articles moves the articles away from the back wall, the top pressure pads 94 and 96 are urged away from the back wall of the rack. The top pressure pads 94 and 96 rotate about the middle leg 86 to urge the bottom pads 98 and 100 toward the back wall of the rack compressing the resilient material 102 of the bottom pressure pads 98 and 100 storing energy therein. When the edge 50 of the articles moves toward the back wall, the energy stored in the bottom pressure pads is released to rotate the top pressure pads 94 and 96 about the middle leg 86 to maintain the top pressure pads 94 and 96 in engagement with the articles thereby preventing the path of oscillation from increasing.

Referring to FIG. 1, there is shown a pair of rods 110 connected at each end to one of the outer legs 92 of the H-shaped member about the middle leg 86. The rods prevent ends of the H-shaped member from tilting out of the rack when the rack is empty, thereby preventing any damage to the H-shaped member from accidental bumping.

As can be appreciated by those skilled in the art, certain modifications can be made without deviating from the scope of the invention. For example, the hollow rigid member 54 of the restraining device 20 may be mounted in the horizontal position rather than the vertical position as shown in FIG. 1.

Figure 6:
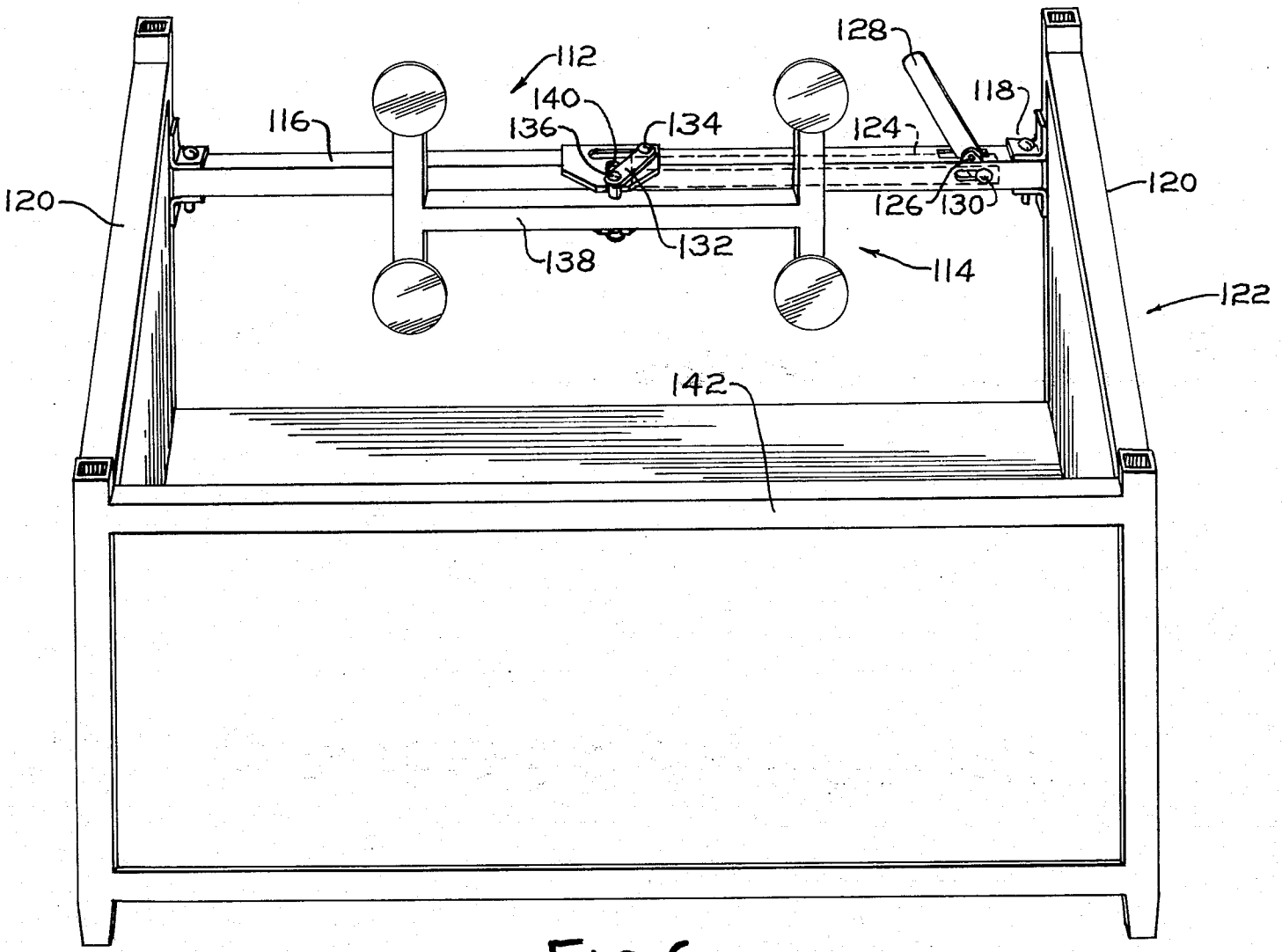
FIG. 6 is an isometric view of a bin illustrating an alternate embodiment of the restraining device of the invention.

More particularly, and with reference to FIG. 6, there is shown a restraining device 112 having an H-shaped member 114 similar to the H-shaped member 88 of the restraining device 20 (see FIG. 1). A hollow rigid member 116 similar to the hollow rigid member 54 is advantageously mounted at 118 to walls 120 of bin 122.

A rigid bar 124 is positioned in the hollow rigid member 116 and is pivotally connected at 126 to a lever 128. An end of the lever 128 is pivotally connected at 130 to the rigid member 116. The other end of the bar 124 is pivotally connected to an end of a pair of plates 132 by way of a stud 134. The other end of each of the plates is pivotally connected to a stud 136. The stud 136 is pivotally mounted to middle leg 138 of the H-shaped member 114.

Rotating the lever 128 in a first direction moves the stud 136 out of a nest 140 similar to the nest 90 (see FIG. 4) to urge the H-shaped member 114 toward back wall 142 of the bin 122. Rotating the lever 128 in a direction opposite to the first direction moves the stud 136 into the nest 140 to move the H-shaped member away from the back wall 142 of the bin 122.

DETAILED DESCRIPTION OF THE INVENTION

With reference to FIGS. 1, 2 and 3, 55 automotive windshields 12, 27 inches wide, i.e., between edges 26 and 50, 64 inches in length at their widest points, and ¼ inch thick, are loaded for shipping in the rack 10 (shown in FIG. 1). The movable runners 28 are adjusted at 65 inches apart and secured in place in any conventional manner. The edge 26 of the windshields 12 are positioned on resilient pads 24 of stationary runners 22 between movable runners 28 (see FIG. 2). Resilient pads 46 of the top support member 34 are spaced about 5 inches from edge 50 of the windshield and resilient pads 48 of bottom support member 36 are spaced about 5 inches from the edge 26 of the windshield. The bottom support member 36 extends beyond the cross members 32 of the back wall to provide a tilt of about 5° to the windshields for packing stability. Corrugated cardboard spacers 50, ¼ inch thick, are inserted between each windshield as shown in FIG. 3.

After the rack is loaded, a restraining device 20 is positioned at the ingress end 18 of the rack by inserting male inserts 60 of a span member 58 in ends of posts 62 and sliding stud 56 in hole 64 of plate 66 attached to the base 14 as shown in FIG. 1. The span member is made of 2⅛ inch square structural steel tubing having ⅛ inch wall thickness. The retaining plate is ¼ inch thick and welded to the base 14. The restraining device 20 has a hollow rigid member 54 made of 3 inch by 1 inch structural steel tubing having a wall thickness of about ⅛ inch. The restraining device includes an H-shaped member 88 having a middle leg 86 made of 1⅛ inch diameter structural steel tubing having about a 5/16 inch wall thickness and outer legs 92 made of 1½ inch square structural steel tubing having about a ⅛ inch wall thickness. The ends of the legs 92 are swaged to ¾ inch thickness (see FIG. 5).

With reference to FIGS. 1 and 4, attached to the top end of the outer legs by way of ½ inch thick threaded shaft 106 is a pair of top pressure pads 94 and 96. In like manner, a pair of bottom pressure pads 98 and 100 are mounted on the bottom of the outer legs. The pressure pads are about 4 inches in diameter and include a ⅛ inch thick metal disc 104 and a ¼ inch thick rubber layer 102 having a durometer reading of 30 bonded to the disc 104. The center of the pressure pads 94 and 96 is spaced about 4 inches from the edge 50 and the center of the pressure pads 98 and 100 is spaced about 4 inches from the edge 26 of the windshield. The pressure pads 94, 96 and 98, 100 are in generally spaced alignment with resilient pads 46 and 48 of the back support members 34 and 36, respectively.

The middle leg 86 is spaced about 3 inches from the center of the pressure pads 94 and 96 and about 16 inches from the center of the pressure pads 98 and 100. The pressure pads 96, 100 and 94, 98, respectively, are on a center-to-center spacing of about 19 inches. The distance from pressure pads 100 and 98 from the left side and right side, respectively, as viewed in FIG. 2, is about 16 inches. The center-to-center spacing between pads 96, 100 and 94, 98, respectively, is about 32 inches.

After the rack is loaded, it is rotated 90° to rest on the back wall 16. The threaded shafts 106 are rotated until the pressure pads 94, 96, 98 and 100 are in surface contact with the outermost windshield. Lever 80 of the restraining device 20 is then rotated counterclockwise as viewed in FIG. 2 to displace a bar 68 made of structural steel downward to move the H-shaped member 88 toward the back wall. The H-shaped member has a ⅜ inch throw and urges the windshield against the resilient pads 46 and 48 to compress the spacers 52. Compressing the spacers urges the windshields toward each other and the windshields generally act as a unit during transit. The rack 10 is then set on the base 14 and stored or loaded on a truck or freight car.

During transit, motion of the freight car tends to oscillate the edge 50 of the windshields about the edge 26. When this occurs, the pressure pads 94 and 96 apply a force to a top portion of the windshields adjacent the edge 50 that is equal to or greater than the resultant moment of force acting on the top portion and the pressure pads 98 and 100 apply a force to a bottom portion of the windshields adjacent the edge 26 that is equal to or greater than the resultant moment of force acting on the bottom portion as viewed in FIG. 2 but less than the force of the pressure pads 94 and 96. In this manner, the rotation of the windshields is generally prevented without applying a bending moment to the windshields between the edges 26 and 50. Further, as the edge 50 of the windshield is urged away from the back wall due to motion of the freight car, the top pressure pads 94 and 96 are urged away from the back wall and rotate about the middle leg to move the bottom pressure pads 98 and 100 toward the back wall. This causes the rubber 102 of the bottom pressure pads 98 and 100 to compress and store energy. When the windshields rotate toward the back wall due to motion of the freight car, the energy in the rubber 102 is released to rotate the top pressure pads 94 and 96 toward the back wall to maintain the top pressure pads 94 and 96 in constant engagement with the windshields thereby preventing the path of oscillation from increasing.

At the point of destination, the lever 80 is rotated clockwise as viewed in FIG. 2 to move the H-shaped member away from the windshields. The restraining device is removed from the ingress end of the bin and the windshields are unloaded as needed.

What is claimed is:

1. In combination with a bin for shipping a plurality of sheets wherein the bin is of the type having a base and a substantially vertical backwall for supporting the sheets in a generally vertical position on an edge, a front restraint device comprising:

at least one rigid member having a first end and a second end opposite to the first end; and means held in position in a plane substantially parallel with the backwall and pivotally mounting said at least one rigid member between the first and second end thereof in spaced relation to the backwall to pivot said at least one rigid member about an axis generally parallel to the backwall and to the base of the bin.

2. The combination as set forth in claim 1 wherein the first end of said at least one rigid member is farthermost from the base of the bin and further including:

means providing a sheet engaging surface on a surface of said at least one rigid member adjacent the first end and adjacent the second end of said at least one rigid member and facing the backwall of the bin; and a ratio of the distance between the pivotal axis to said engaging surface adjacent the second end of said at least one rigid member to the distance between the pivotal axis to said engaging surface adjacent the first end of said at least one rigid member of at least about 1 to 1.

3. The combination as set forth in claim 1 further including:

means for displacing said at least one rigid member toward and away from the backwall of the bin.

4. The combination as set forth in claim 1 further including resilient means mounted on said at least one rigid member and facing the backwall of the bin.

5. The combination as set forth in claim 4 wherein said resilient means is a first pad mounted on said at least one rigid member adjacent the first end and a second pad mounted on said at least one rigid member adjacent the second end and further including:

means mounting at least one of said pads on said at least one rigid member for incrementally displacing said at least one of said pads toward and away from the backwall of the bin.

6. The combination as set forth in claim 5 wherein said incremental displacing means is a threaded shaft having one end threaded into said at least one rigid member and pivotally mounted at the other end to said at least one of said pads.

7. The combination as set forth in claim 1 wherein the first end of said at least one rigid member is farthermost from the base and the ratio of distance between the pivotal axis to said second end of said at least one rigid member and distance between the pivotal axis to said first end of said at least one rigid member is between about 1 to 1 and about 5 to 1.

8. The combination as set forth in claim 1 wherein the sheets are glass sheets.

9. In combination with a bin for shipping a plurality of sheets wherein the bin is of the type having a base and a substantially vertical backwall for supporting the sheets in a generally vertical position on an edge, a front restraint device, comprising:

a pair of rigid members each having a first end and a second end opposite to the first end;

means held in position in a plane substantially parallel with the backwall and pivotally mounting said rigid members between the first and second ends thereof in spaced relation to the backwall to pivot said members about an axis generally parallel to the backwall and to the base of the bin; and resilient means mounted on each of said rigid members adjacent the first and second ends and facing the backwall.

10. The combination as set forth in claim 9 wherein said pair of rigid members are mounted in spaced relation on a rigid cross member which is pivotally mounted on said pivotal mounting means.

11. The combination as set forth in claim 9 wherein said pair of rigid members are pivotally mounted in spaced relationship on a rigid cross member to pivot said rigid members toward and away from the backwall of the bin.

12. The combination as set forth in claim 7 further including a threaded shaft threaded into each of said pair of rigid members adjacent their ends and having one of said pads pivotally mounted on the opposite end of said threaded shaft for incrementally displacing said pads toward and away from the backwall.

13. The combination as set forth in claim 12 further including means mounting said rigid cross member for displacing said rigid members toward and away from the backwall.

14. The combination as set forth in claim 13 wherein said displacement means includes:

a cam member securely mounted at one end to said rigid cross member;

a movable shaft having a first and second end, the first end pivotally connected to the other end of said cam member; and a lever pivotally mounted at a point off center to the second end of said movable shaft wherein rotating said lever in a first direction urges said rigid members toward the backwall and rotating said lever in a second direction displaces said rigid members away from the backwall.

15. The combination as set forth in claim 14 wherein the ratio of the distance between said rigid cross member to said second pads and the distance between said rigid cross member to said first pads is between about 1 to 1 and about 5 to 1.

16. The combination as set forth in claim 9 wherein said resilient means is a first pad adjacent the first end of each of said rigid members and a second pad adjacent the second end of each of said rigid members and further including:

means mounting at least one of said first or second pads on said at least one rigid member for incrementally displacing said at least one of said first or second pads toward and away from the backwall of the bin.

17. The combination as set forth in claim 13 wherein the sheets are glass sheets.

* * * * *